US007061399B2

(12) United States Patent
Leck

(10) Patent No.: US 7,061,399 B2
(45) Date of Patent: Jun. 13, 2006

(54) MONITOR SYSTEM

(76) Inventor: Michael John Leck, 12 Swaledale, Galgate, Lancaster LA2 0RL (GB)

( * ) Notice: Subject to any disclaimer, the term of this patent is extended or adjusted under 35 U.S.C. 154(b) by 500 days.

(21) Appl. No.: 10/449,448

(22) Filed: May 30, 2003

(65) Prior Publication Data

US 2004/0066271 A1 Apr. 8, 2004

(30) Foreign Application Priority Data

Oct. 4, 2002 (GB) ..... 0222989.6

(51) Int. Cl.
*G08C 19/04* (2006.01)

(52) U.S. Cl. ..... 340/870.06; 340/870.11; 340/539.1; 340/539.22

(58) Field of Classification Search ..... 340/870.06, 340/870.11, 870.16, 539.1, 539.22, 517
See application file for complete search history.

(56) References Cited

U.S. PATENT DOCUMENTS

| | | | | |
|---|---|---|---|---|
| 5,910,765 | A * | 6/1999 | Slemon et al. | 340/517 |
| 6,100,806 | A | 8/2000 | Gaukel | 340/573.4 |
| 6,420,971 | B1 | 7/2002 | Leck et al. | 340/542 |
| 6,624,760 | B1 * | 9/2003 | Kinzel et al. | 340/870.11 |
| 6,825,777 | B1 * | 11/2004 | Vock et al. | 340/870.05 |
| 6,914,539 | B1 * | 7/2005 | Hoctor et al. | 340/870.12 |
| 6,924,746 | B1 * | 8/2005 | Hermary et al. | 340/870.06 |

FOREIGN PATENT DOCUMENTS

| | | |
|---|---|---|
| GB | 2186404 | 8/1987 |
| GB | 2283847 A | 2/1994 |
| WO | 00/070573 A1 | 11/2000 |

* cited by examiner

*Primary Examiner*—Albert K. Wong
(74) *Attorney, Agent, or Firm*—Whyte Hirschboeck Dudek SC

(57) ABSTRACT

An apparatus for remotely monitoring variables comprising: one or more independently powered remote monitoring devices having means for sensing variables coupled to a microprocessor for receiving and processing variable data and means for transmitting the variable data to a control device; a control device having a means for receiving variable data from the one or more remote monitoring devices, coupled to a microprocessor for processing variable data and means for transmitting data to the one or more remote monitoring devices; the one or more remote monitoring devices being momentarily activated at programmed intervals, wherein during activation, the one or more remote monitoring devices transmit a beacon signal to the control device and/or further transmits processed variable data from the and/or a previous activation period, the one or more remote monitoring devices resuming a sleep mode after such transmission(s) and at the end of the activation period, the activation period being extendible.

22 Claims, 6 Drawing Sheets

MONITOR SYSTEM

BACKGROUND OF THE INVENTION

The present invention relates to an apparatus and method for remotely monitoring variables comprising of momentarily activated remote monitoring devices that are capable of transmitting data to a control device.

Remote sensors have been used for a number of years for monitoring and relaying information relating to the environment in which they are placed to a central monitoring system. The sensors are, for example, used to measure and record at regular intervals, environmental conditions such as temperature, humidity, gas concentration, geographic location and so on. Other examples are sensors that are used to measure mechanical quantities such as stress, strain, tilt, vibration and system integrity. Sensors can also be used to measure and record physiological variables such as heart rate, blood pressure, body temperature, and the like. Self-sensing electronic seals can also sense and record their own security state at regular intervals. For the purposes of this invention all types of these devices will be referred to as "remote monitoring devices."

Prior art teaches that a control device can communicate with a plurality of monitors by "polling," whereby only the correctly addressed monitor transmits or receives information. Unfortunately, this technique increases the power used by the monitors since each one must remain awake long enough to determine whether or not it is being addressed and each must also be awake at the right time to receive and check the next "poll." For just one or two monitors this may not be serious problem, but if many thousands of electronic seals in a goods yard need to be polled on a regular basis, the lifetime of their batteries would be greatly reduced. In such situations, replacing drained batteries would be costly and impractical.

U.S. Pat. No. 6,100,806 discloses an apparatus and method for continuous electronic monitoring and tracking of individuals by utilising the Global Positioning System (GPS) satellites and cellular telephone communications. Remote units comprise the position and data sensor as well as a transmitter device to transmit the information back to a central tracking station. A problem associated with this system is the need for a constant supply of electricity in order to supply data continuously to the central tracking unit, thus the apparatus is only effective if remote batteries are replaced frequently. If the batteries are not replaced frequently, the apparatus quickly becomes inoperable and ineffective for tracking individuals or other data of interest.

U.S. Pat. No. 6,420,971 discloses a security seal whereby the seal awakes periodically, checks and records its security state, emits an infrared beacon, checks for a valid response from an remote device and returns to sleep if none is detected.

BRIEF SUMMARY OF THE INVENTION

It is an object of the present invention to provide an apparatus and a method to monitor variables remotely, which addresses the problems of high energy consumption and that is secure from third party intervention and such an intervention would be detectable.

In accordance with the present invention, there is provided an apparatus for remotely monitoring variables comprising:

a) one or more independently powered remote monitoring devices having means for sensing variables coupled to a microprocessor for receiving and processing variable data and means for transmitting the variable data to a control device;

b) a control device having a means for receiving variable data from the one or more remote monitoring devices, coupled to a microprocessor for processing variable data and means for transmitting data to the or each remote monitoring device;

the one or more remote monitoring devices being momentarily activated for a period of time at programmed intervals, wherein during such momentary activation period the one or more remote monitoring devices transmits a beacon signal to the control device and/or further transmits up to 1 byte of any processed variable data from the and/or a previous momentary activation period, the one or more remote monitoring devices resuming a sleep mode after such transmission(s) and at the end of the momentary activation period, the momentary activation period being extendible by means of a signal transmission from the control device.

The typical operation of a remote monitoring device can summarised by a sequence of one or more of the following events:

a) Awake from low power sleep mode at predetermined intervals, for example every one second.

b) Measure and as required save in memory the variables and/or status to be measured or transmitted to a control device for further processing.

c) Emit or transmit a short electromagnetic pulse (a beacon) with which a control device can synchronise to receive or transmit information.

d) Transmit one-bit of information.

e) Check for a valid response to the beacon from a control device within an allotted time period.

f) If a valid response is not detected, return to inactive sleep mode.

g) If a valid response is detected, remain awake to complete the transaction with the control device before returning to sleep mode.

h) Awake at the next predetermined time and repeat the sequence indefinitely.

In accordance with a second aspect of the present invention, there is provided an apparatus for remotely monitoring variables, wherein the means for transmitting data comprises 1 bit. Preferably, the means for transmitting data may comprise 7 bits or less. More preferably, the means for transmitting data may comprise 6 bits or less. More preferably, the means for transmitting data may comprise 5 bits or less. Even more preferably, the means for transmitting data may comprise 4 bits or less. More preferably again, the means for transmitting data may comprise 3 bits or less. Most preferably, the means for transmitting data may comprise 2 bits or less.

A further aspect of the present invention provides an apparatus for remotely monitoring variables, wherein the extension of the activation period of the one or more remote monitoring devices is reliant upon an activation signal sent from the control device in response to the beacon.

In another aspect of the present invention, there is provided an apparatus for remotely monitoring variables, wherein the control devices may be linked to further control systems. Thus the variables may be sent via other networks or systems to a central base station for further analysis. Alternatively, a central base station may control a suit of control devices in order to transmit with the one or more remote monitoring devices. Data transfer may take place over a number of different modes, such as Local Area Networks, Wide Area Networks, secure cellular telecommunication networks, radio or satellite communications systems. In order to effectively track each remote monitoring device, each remote monitoring device has a unique electronic serial number or address. This assists a control device communicate with the correct monitor by addressing it with its unique serial number. The monitor may also contain a hierarchy of electronic passwords that would need to be known to a control device in order for it to control how the one or more remote monitoring devices function and to write, or retrieve, information. Furthermore, if the location of a control device is important in a particular application, it may utilize Global Positioning Satellite (GPS) or Global System for Mobile Communication (GSM) technology to establish a grid reference of the device.

In yet another aspect of the present invention, there is provided an apparatus for remotely monitoring variables, wherein the transmission means comprises electromagnetic or acoustic energy. The transmission means may be via one or more or a combination of the following group: radio waves, infrared radiation, microwave radiation and sound waves. The one or more remote monitoring devices may be momentarily activated for a short periods of time, preferably within the range of 1 to 100 micro seconds. The one or more remote monitoring devices may be momentarily activated at intervals of about 1 second. Preferably the one or more remote monitoring devices is programmed to activate or awaken at an interval from a fraction of a second to several hundred seconds.

In accordance with a further aspect of the present invention, there is provided an apparatus for remotely monitoring variables wherein the one or more remote monitoring devices is a sensor that measures a physical variable by means of a transducer. The one or more remote monitoring devices may be a self-sensing electronic seal. Furthermore, the one or more remote monitoring devices may be used to protect and monitor goods in transit or storage.

The apparatus for remotely monitoring variables may require one or more passwords prior to establishing transmission between the one or more remote monitoring devices and the control devices. The transmission of data may be by means of one-bit transmittal employing a modulated or variable length radio frequency or infra-red pulse. Furthermore, the transmission of data may be by means of a data packet. Preferably, the data-packet will contain a checksum. More preferably, the data packet will also contain error-correcting codes. Even more preferably, the data packet will also be self-synchronising. Additionally, the data-packet may optionally also contain encrypted information, which may be encrypted by means of rolling-encryption. The control device may also employ an adaptive reception for the one-bit transmittals from a remote monitoring device.

In accordance with another aspect of the present invention, there is provided a method of remotely monitoring variables comprising:

a) one or more independently powered remote monitoring devices having means for sensing variables coupled to a microprocessor for receiving and processing variable data and means for transmitting the variable data to a control device;

b) a control device having a means for receiving variable data from the one or more remote monitoring devices, coupled to a microprocessor for processing variable data and means for transmitting data to the or each remote monitoring device;

the one or more remote monitoring devices being momentarily activated for a period of time at programmed intervals, wherein during such momentary activation period the one or more remote monitoring devices transmit a beacon signal to the control device and/or further transmits up to 1 byte of any processed variable data from the and/or a previous momentary activation period, the one or more remote monitoring devices resuming a sleep mode after such transmission(s) and at the end of the momentary activation period, the momentary activation period being extendible by means of a signal transmission from the control device.

The present invention, discloses a highly energy efficient apparatus and method for remotely monitoring variables. When not transferring information, the duty-factor of the remote monitoring device is preferably of the order of 1 in $10^4$ to 1 in $10^5$, resulting in considerable power saving and extended battery life. However, any duty factor from more than 1 in $10^1$ to less than 1 in $10^7$ could be used. These remote monitoring devices are, therefore, very energy efficient and can operate for long periods of time from a small battery or other source of energy.

Only when a control device makes a valid response to the remote monitoring device beacon with the correct address and password does a remote monitoring device remain awake long enough to complete the transaction with the control device. This, for example, could include transferring stored measurements or receiving information and settings from the control device.

BRIEF DESCRIPTION OF THE DRAWINGS

A specific embodiment of the present invention will now be described, by way of example only, with reference to the accompanying figures, in which.

DETAILED DESCRIPTION OF THE PREFERRED EMBODIMENTS

Figure 1:
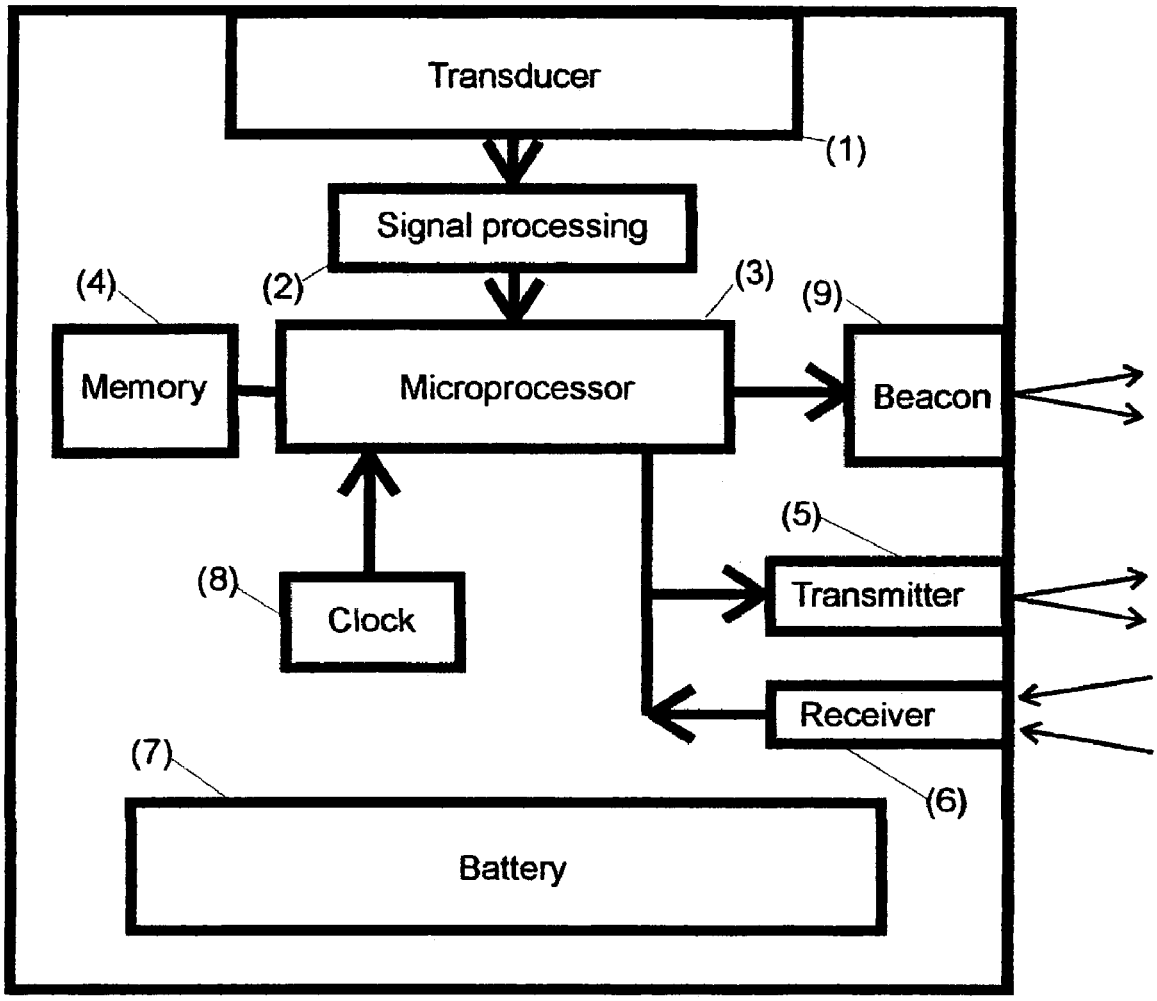
FIG. 1 shows a generalised arrangement of a remote monitoring device.

With reference to FIG. 1, there is provided a remote monitoring device which consists of a transducer 1 to convert the variable physical data into an electrical signal, a signal processing unit 2 for processing the electrical signal, a microprocessor 3 to control the operation of the remote monitoring device and a memory 4 to store information linked to a microprocessor 3. The microprocessor is also linked to a clock 8 and a receiver 6. Additionally, the microprocessor 3, can output information to the beacon 9, the memory 4 and the transmitter 5. The remote monitoring device is powered by means of a battery 7. Those skilled in the art will also realise that in addition to being powered by a battery, solar or motion power may also be used as a supplementary power source or to re-charge the battery. The microprocessor 3 also controls the provision of electrical power to the various parts of the remote monitoring device and has the capability of placing the device in sleep mode whereby all parts are inactive apart from the clock that is used to wake-up the remote monitoring device at chosen times.

The remote monitoring device is equipped with an accurate clock 8 that has previously been set to an agreed time reference. Using this clock, the remote monitoring device activates momentarily at regular intervals. The time interval between successive awakenings is called the 'wake-up' interval. All remote monitoring devices in a system are set to use the same wake-up interval but the time of activation is not synchronised with other remote monitoring devices and therefore each remote monitoring device will, statistically speaking, be momentarily awake at a different time. Alternatively, the time of activation for each remote monitoring device is pre-determined to allow for each device to activate at a different time to any other remote monitoring device. By using a method of momentary activation, the life of the battery 7 is greatly enhanced as the power required to maintain the remote monitoring device is greatly reduced.

The clock 8 may be regulated by a number of methods, but a typical crystal controlled clock is adequate as it has an accuracy of about 20 parts per million (PPM). This corresponds to an accuracy of better than 20 microseconds per second, 2 seconds per 24 hours, or better than 15 minutes per year. The clock 8 is also required in order to record the times at which measurements are made by the remote monitoring device.

Upon awakening the remote monitoring device can communicate and transfer information to or from a control device on a one-to-one basis using its beacon 9. In order that the remote monitoring device can communicate with the control device, the beacon 9 emits a short pulse of electromagnetic energy, infrared (IR) or radio frequency (RF) would be suitable types of electromagnetic energy for communication and transmission purposes. To aid discrimination from noise, the pulse may be modulated at a chosen frequency. The duration of the beacon's pulse is preferably between 1 and 10 microseconds, but it will be apparent to those skilled in the art that any practical pulse duration could be used.

The transmission between the remote monitoring device and the control device remote device is bi-directional and uses the remote monitoring device transmitter 5 and the receiver 6 and the transmission will usually be by means of electromagnetic energy as used by the beacon 9. It will be apparent to those skilled in the art, that the beacon 9 and transmitter 5 could utilise the same source of electromagnetic energy. If no transmission is made between the control device and the remote monitoring device, via the receiver 6 in response to the remote monitoring device beacon in an allotted time then the remote monitoring device de-activates until its next wake-up. The allotted time is preferably no longer than 10 microseconds, but any practical time between one and several hundred microseconds could be used. If a valid response to the beacon 9 is detected, the remote monitoring device will remain active for a time period long enough to complete the transaction with the control device on a one-to-one basis.

This one-to-one method of transmission is, for example, used to read or write infonmation to the remote monitoring device memory 4, change the settings of the remote monitoring device or to set the monitor's clock 8 to an alternative reference time. Passwords may be utilised in order to allow transmission between the remote monitoring device and the control device and one or more passwords may need to be known by them in order to successfully accomplish any of these operations.

The present invention may also employ an alternative method of transmission whereby information can be broadcast to one or more control devices. The infonnation to be broadcast is prepared as a data-packet by a remote monitoring device during one or more of its previous momentary awakenings prior to transmission. The data-packet will contain at least one and possibly several hundred bits of information. To broadcast the information in the data-packet to one or more control devices, one-bit transmission is used with the transmitter 5 of the remote monitoring device sending one-bit of the data-packet per wake-up. The control devices nonnally do no not acknowledge receipt of the broadcast, although it will be apparent that this feature may be necessary in certain applications.

A set time after its wake-up, each remote monitoring device transmits the next bit of infonmation from the data-packet held in its memory using its transmitter 5. This is one-bit transmittal of information; the next bit will be transmitted at precisely the same time after the start of its next wake-up. A short pulse of electromagnetic energy is used to transmit the single bit.

The duration of the pulse is between 1 and 10 microseconds, but any practical pulse duration could be used. To distinguish between logical 0 and 1, the pulse may be modulated at different frequencies or be of variable length with, for example, logical 0 represented by a short pulse and logical 1 by a long pulse.

Due to the limited accuracy of the clocks the length of each remote monitoring devices wake-up period will be slightly different. For a typical crystal controlled clock, this difference may be of the order of 20 PPM. Thus if the wake-up interval is nominally set to one second, the actual period may be up to 20 microseconds longer or shorter. The net result is that the time between a remote monitoring device one-bit transmittals may be slightly different than expected.

The control device is designed to accommodate this difference by employing adaptive reception of one-bit transmittals. Regardless of whether a logical 0 or 1 is transmitted, a remote monitoring device sends every bit as a pulse. Accordingly, by searching a time interval around a remote monitoring device's expected next wake-up time, the control device can tune to the exact wake-up interval associated with a particular remote monitoring device.

In another embodiment of the present invention, the one-bit pulses used to transmit the data-packet are also used as a beacon 9 for the one-to-one transmissions means between the remote monitoring device and the control device. That is, the beacon 9 and transmitter 5 are one and the same source of electromagnetic energy. This results in a further energy saving since separate beacon pulses are no longer required.

Since the remote monitoring device only transmits one-bit of information per activation, a high peak power can be transmitted per bit while still using a small battery or other energy source. In fact the transmitted bit is preferably a very intense pulse of just a few microseconds duration. This allows better reception of the pulse by the control device in the presence of competing interference. It also allows weak sources of energy, for example photovoltaic or thermoelectric generators, to be used that would otherwise be depleted if many intense pulses were transmitted in quick succession.

The data-packet transmitted by a remote monitoring device is identified by a unique address and includes a message about the remote monitoring device and the variables that it is measuring. For a remote monitoring device that includes a sensor, the message could contain information on current environmental conditions for example. For a self-sensing electronic seal, the message could state when the seal was last opened, closed or secured.

In the preferred embodiment of this invention, the data-packet is constructed in such a manner that it is self-synchronising. In other words, a control device can receive it correctly without specific start or stop bit patterns or bytes having to be transmitted. This reduces the number of bits that have to be transmitted and thus saving more battery power.

In another preferred embodiment of this invention, the address of the remote monitoring device is a 48-bit number represented as six 8-bit bytes. The address is a large enough number ($2^{48}$ is nearly a million billion) to ensure no two addresses will ever be the same, although, in practice, any number of bits between one and several hundred could be used for the address.

In yet a further preferred embodiment of this invention, the message consists of 32 bits of information represented by four 8-bit bytes. It will be apparent to those skilled in the art that in practice, any number of bits between one and several hundred could be used to convey the message.

To allow the control device receiving a data packet, to prove the validity of the data packet, the remote monitoring device calculates a Cyclic Redundancy Checksum (CRC) from the address and message bytes and includes this CRC with the data packet. To obtain the CRC, it performs a mathematical calculation on the block of data to give a number that represents the content and organization of that data. The CRC calculation returns a number that uniquely identifies the data and is a well-known technique for error detection.. Therefore it would require a rare combination of events to result in incorrect packet validation by this method. In the preferred embodiment of this invention, the remote monitoring device calculates an 8-bit CRC (know as a CRC-8) and appends this extra byte to the data-packet. Therefore in the preferred embodiment, the data-packet contains 11-bytes, namely a 6-byte address, a 4-byte message and a 1-byte CRC.

It is also preferable for the remote monitoring device to add error correction bits to the data-packet before transmission. The remote monitoring device does not know whether or not the packet has been correctly received by the control device and cannot be instructed to resend it. Much the same situation exists in the transmission of data for distant space probes. Techniques for error correction are well known to those versed in the art of data transmission (for example, see Morelos-Zaragoza, R., The Art of Error Correcting Coding (2002)). In one embodiment of this invention, Hamming Codewords are employed for establishing whether or not a packet has been received properly. Extended Hamming {16,11} Codewords are preferred, a 16-bit codeword being generated from 11 bits of data according to a well-known encoding process. This method provides correction for all single bit errors in each codeword and detection (but not correction) of 2-bit errors in each codeword.

Figure 2:
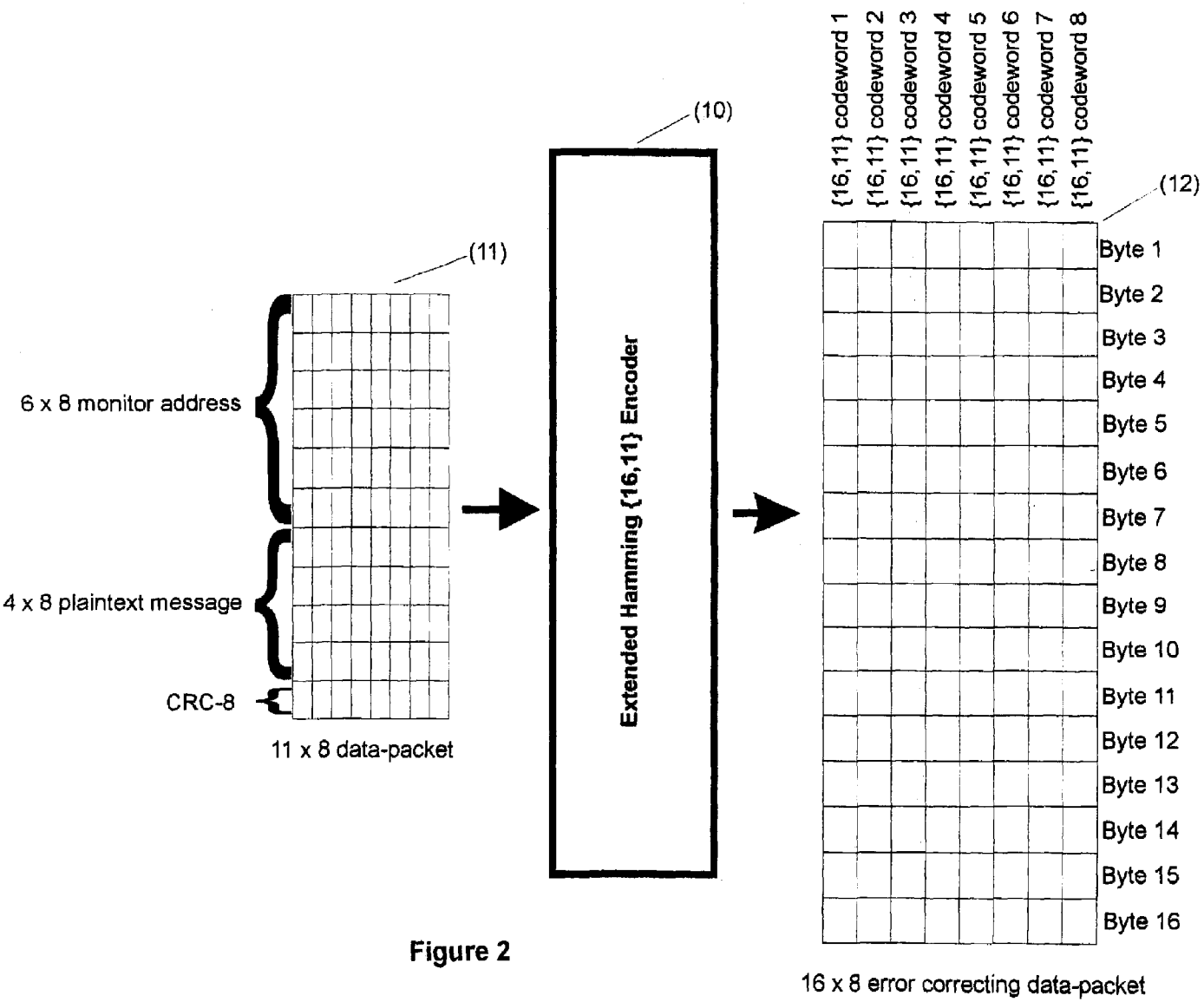
FIG. 2 illustrates the construction of an error correcting data-packet.
Figure 3:
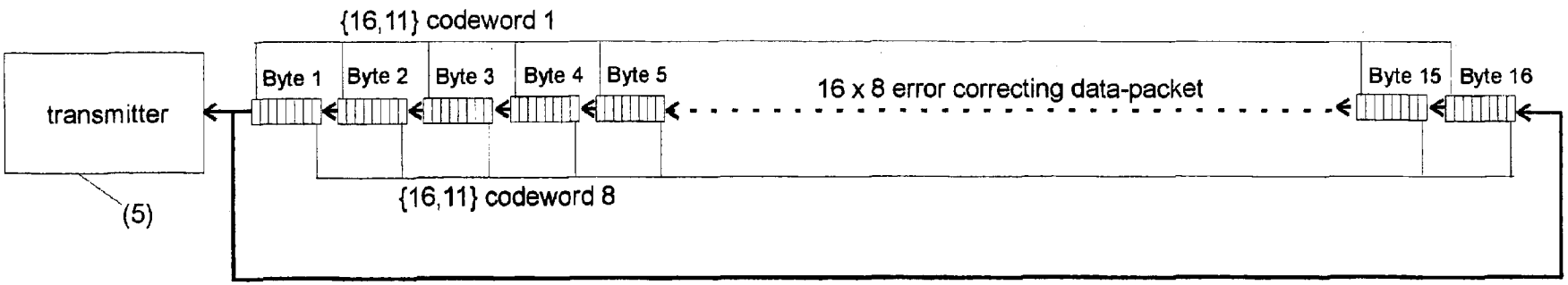
FIG. 3 illustrates the one-bit transmittal of a data-packet.

With reference to FIG. 2, eight 16-bit Codewords 12 are generated from the original 11-byte data-packet 11 by an Extended Hamming Encoder 10. The resulting error correcting data-packet then consists of sixteen 8-bit bytes or 128 bits. These are transmitted in bit order byte-by-byte as illustrated by FIG. 3 by using simple circular right or left shifting of the bits in the 16 bytes. The next bit in the sequence is transmitted by the transmitter 5 every time the remote monitoring device awakes. Thus, if the monitor is programmed to awake once per second the entire packet will be transmitted in 128 seconds. After the last bit has been transmitted the sequence repeats without any gaps until the data-packet is changed.

Using this transmission method, the Hamming Codewords become naturally interleaved with 8-bit times between successive bits of a codeword. This provides enhanced protection against burst errors, that is, errors caused by signal interference that lasts for several seconds.

Reception by the control device is the reverse of transmission and for each remote monitoring device, each received bit is right or left shifted into a group of sixteen 8-bit shift registers. The use of Hamming Codewords is particularly beneficial as they allow the data-packet to successfully self-synchronize in the control device. Each 16-bit Extended Hamming Codeword has 2048 allowed bit patterns out of the possible 65536 patterns of 16 bits. That is, only 1 in 32 of the possible bit patterns are valid Codewords. If 1-bit error corrections are taken into account, this increases to 1 in 16. If a sequence of 1's or 0's were received at random, there is a 1 in 16 chance of them forming a valid Codeword. Since the data packet consists of eight 16-bit Codewords, the probability of the control device receiving at random 128-bits that from eight valid Codewords is about 1 in $2^{32}$ or about 1 in 4 billion. This is a rare but not entirely improbable event. However, the presence of a CRC-8 in the data-packet makes correct self-synchronization possible in all circumstances, for in the rare event of eight code-words being formed from 128 random bits, the probability of those Codewords forming a data-packet with a valid CRC-8 is extremely unlikely.

Figure 4:
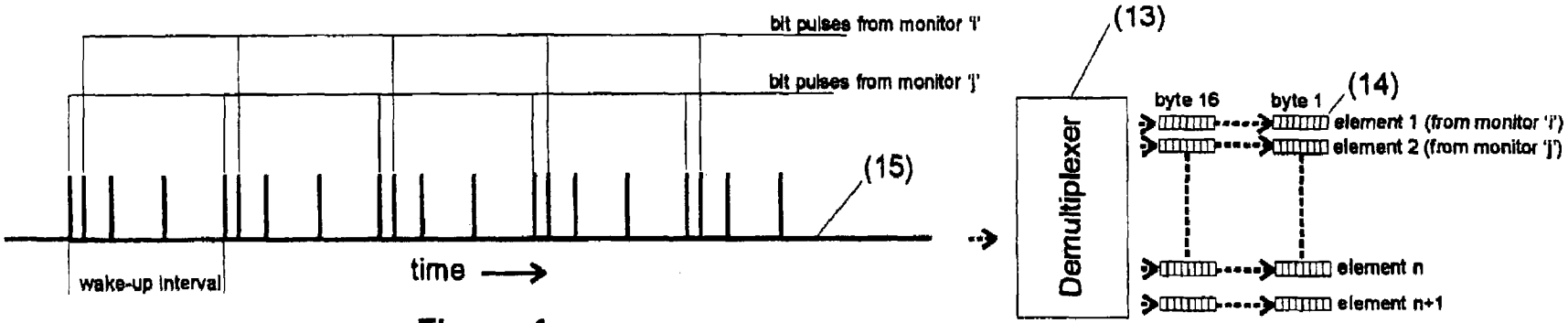
FIG. 4 illustrates the reception of multiple data-packets.

The preferred reception scheme is as illustrated by FIG. 4. As each bit pulse is received (for example, one-bit every one second from each remote monitoring device in the most preferred embodiment) it is shifted into array shift registers. Each array element 14 consists of sixteen 8-bit shift registers. A Time Division Demultiplexer 13 is used to switch the received bit stream 15 between different array elements 14. Bits from a given remote monitoring device are always exactly a wake-up period apart. The demultiplexer 13 dynamically allocates one element of the array of shift registers to each remote monitoring device it wishes to simultaneously receive. Bits transmitted by other remote monitoring devices, although having the same wake-up interval, are very unlikely occur within the same demultiplexer time division and are allocated to different elements in the array of shift registers. This is shown in FIG. 4 for the bits from monitors 'i' and 'j'. The width of a time division, or the time window in which a pulse from a given monitor must fall, is preferably about 10 microseconds, but any time division between 1 and several hundred microseconds could be used. Generally speaking, the narrower this window the less chance of pulses from other monitors occurring within it and the greater the number of remote monitoring device broadcasts that can be received simultaneously. However, if the time window is too narrow, short-term clock jitter may cause pulses to be missed and therefore the time window can be selected or adapted depending on the application or the number of remote monitoring devices.

For each element in the array of shift registers 14, the receiver checks to see whether or not the last 128-bits it received form eight valid Extended Hamming {16,11} Codewords that allow the bits to be decoded to an 11 byte possible data-packet. If so, there is a possibility that a valid data packet has been received in that array element. To prove whether or not this is the case, the receiver then validates the data-packet by calculating and comparing its CRC-8. If the data packet proves to be valid, then the appropriate action is taken to use the information in the data-packet. Alternatively, if eight Codewords are not in the shift registers, then either the reception is not yet synchronized with the data packet or at least one un-correctable error has occurred. In either case the control device waits for the next bit to be received into that array and repeats the checks until a valid data-packet is received.

In a further embodiment of the invention, which gives even more protection against transmission errors, two dimension extended Hamming Codewords are employed. These are sometimes known as Product Codes.

Figure 5:
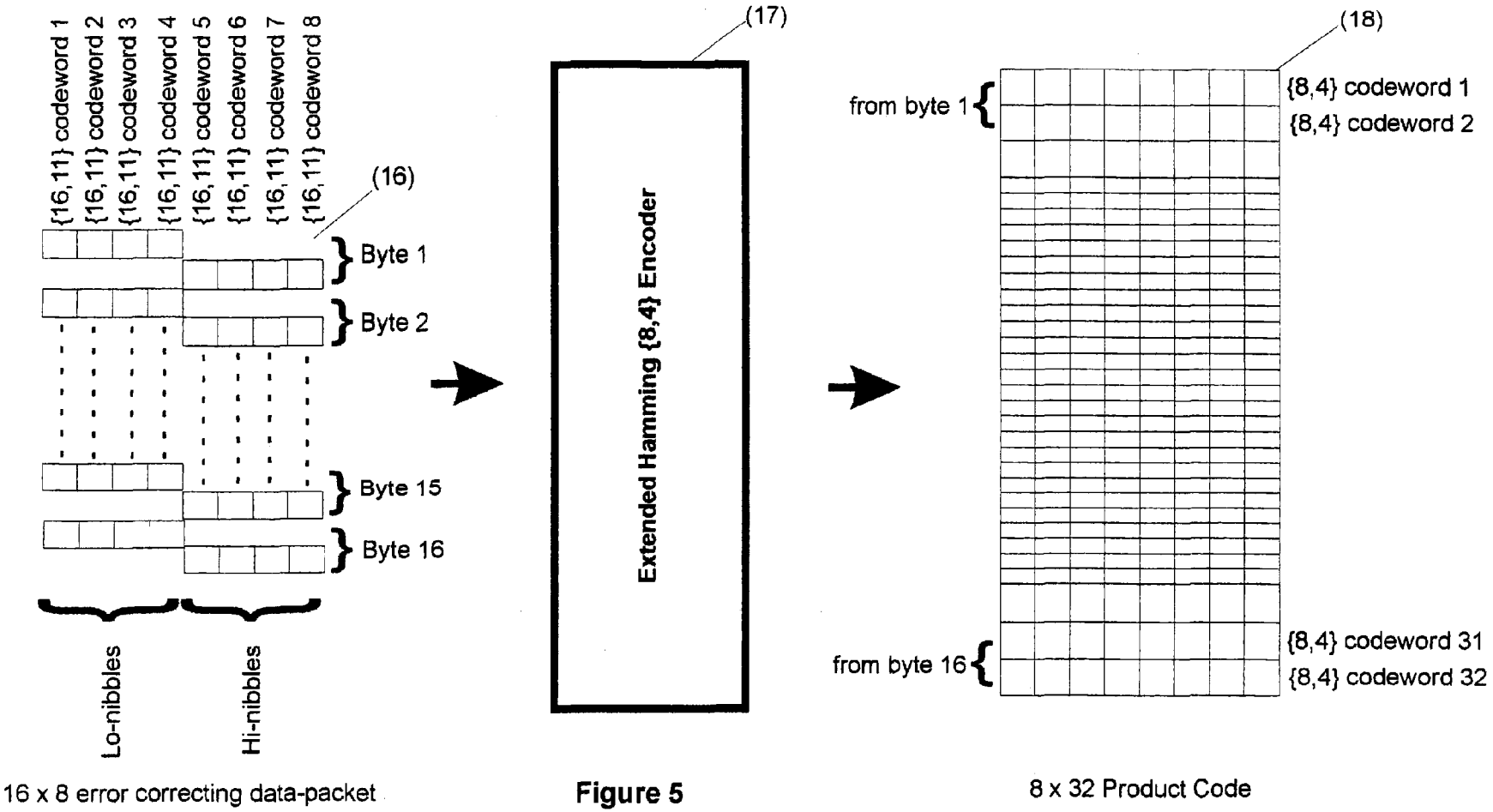
FIG. 5 illustrates the generation of a product code data-packet.

Referring to FIG. 5, each of the sixteen 8-bit bytes to be transmitted is first split into two 4-bit nibbles 16. An Extended Hamming {8,4} Codeword is then encoded 17 from each nibble in turn to create a 32-byte Product Code data-packet 18 to be transmitted bit-by-bit. These 256-bits take twice as long to transmit but allow more than twice as many errors to be corrected. Again the bits can be interleaved in some agreed fashion to reduce burst errors. This scheme is beneficial in very noisy environments. Reception follows a similar scheme to that described previously, except that in this case a valid two-dimensional array of Hamming Codewords has first to be received for each monitor before the data packet CRC-8 is validated.

In a yet further embodiment of this invention, the message portion of the data-packet transmitted by the remote monitoring device is encrypted before transmission, preferably using rolling-encryption whereby the cipher key used by the encryption algorithm changes at regular intervals. This is particularly important for remote monitoring devices that contain self-sensing electronic seals. A skilled thief could record the pattern of bits being transmitted and then substitute the electronic seal with a device that just transmits an identical bit sequence. In this situation, the control device receiving the transmission would not discover that the security of the seal had been compromised.

Figure 6:
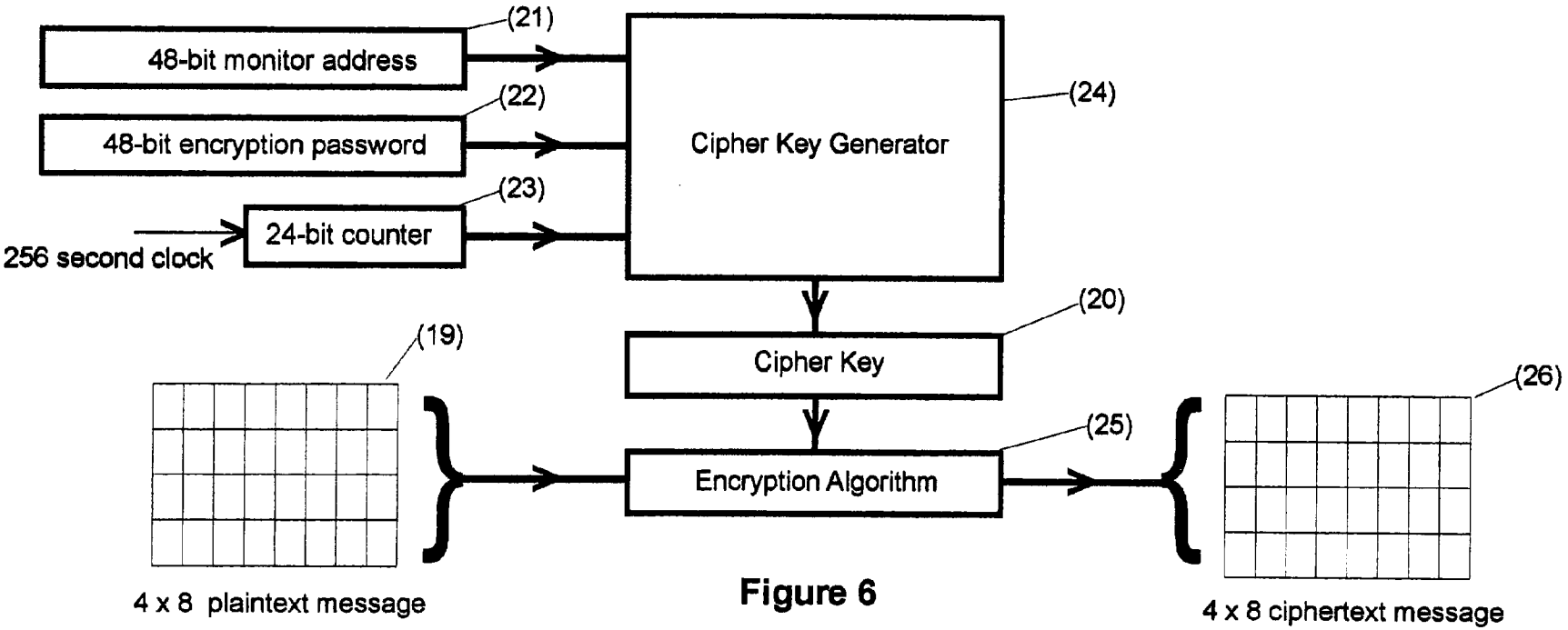
FIG. 6 illustrates an encryption process for the data-packet.

In the preferred embodiment of this invention and with reference to FIG. 6, the 32-bit plaintext message 19 portion of the data-packet 11 is encrypted to 32-bit ciphertext message 26 by rolling-encryption. Rolling-encryption uses a cipher key 20 created by a suitable generator 24 from the remote monitoring device 48-bit serial number 21, an encryption password 22 known only to the remote monitoring device and an authorized control device, and a counter 23 that changes at regular intervals. Preferably, the encryption password is a 48-bit number but, in practice, any number of bits between one and several hundred could be used. Preferably, the rolling-encryption counter is a 24-bit number but, in practice, any number of bits between one and several hundred could be used.

A variety of encryption techniques will be well known to those skilled in the art (for example, Schneier, B., Applied Cryptography: Protocols, Algorithms, and Source Code in C, (1996) outlines a number of encryption techniques). The choice of cipher key generator 24 and encryption algorithm 25 is not important but it follows that, if the encryption algorithm is strong, the transmitted message will change at regular intervals in a way that cannot be predicted without knowledge of the cipher key. This makes it impossible for a skilled thief to substitute the remote monitoring device by a device transmitting a pre-recorded bit sequence.

According to an embodiment of the present invention, the rolling-encryption counter changes at regular intervals and follows a sequence known to the authorized control device. The remote monitoring device real time clock is ideal for this purpose for at some stage it will have been set to some agreed reference time. Further referring to FIG. 6, if a 32-bit register is used to record the time with a resolution of one second, then it can accommodate a time span of about 136 years. The most significant 24-bits of this register 23 will change at 256 second intervals and are ideal for use as the rolling-encryption counter. In the preferred embodiment of this invention, with a 128-bit error correcting data-packet, the encrypted message portion of the packet will change after every two data packets have been transmitted.

If the real time clock of the remote monitoring device is accurate to within 20 PPM, the 24-bit rolling-encryption counter will be known precisely for at least 148 days after synchronization, at worst gaining or loosing one count every 148 days or thereabouts. This does not cause a problem for it is a simple matter to accommodate this drift by deciphering the message with trial values of the rolling-encryption counter at either side of its expected value. Any significant loss of synchronization beyond that expected from typical oscillator drift indicates a fault or that by freezing its clock someone may have tampered with the remote monitoring device or a variable measuring apparatus attached thereon, such as an electronic seal for example.

By employing a strong encryption algorithm, and combining the serial number, encryption password and the rolling-encryption counter into the cipher key, ensures that the encrypted message sequence in the data-packet is only likely to repeat every 136 years and that each remote monitoring device will follow a different sequence.

If a large number of remote monitoring devices are operating in close proximity, there is a small but finite probability that the one-bit transmissions from two or more monitors may interfere. For example, if each monitor transmits a 10-microsecond pulse once per second, then the probability of pulses from another monitor interfering is about 1 in 100,000. If 1000 remote monitoring devices are in the vicinity, the probability of interference between any two increases to 1 in 100 or thereabouts. Relative drift between remote monitoring device clocks will eliminate long-term interference. However, it is preferable that each remote monitoring device can be configured to randomly change its wake-up time at regular intervals. In the preferred embodiment of this invention, remote monitoring device move their wake-up times and hence their bit transmission times by a random or pseudo-random time when a number of complete data-packets have been transmitted. For example, a remote monitoring device could transmit two complete 128-bit data-packets and then change its wake-up time before transmitting the next two data-packets and so on.

The one-bit transmittal invention disclosed here has many advantages over asynchronous serial transmissions in which many bytes of the whole data packet are transmitted in a single transmission. The latter normally requires at least one start and one stop bit per byte, increasing the overall bit count by 25%. These extra bits are also difficult to include in a bit error-correcting scheme. A burst of interference lasting a just few milliseconds may coincide with many bytes of the transmission and will probably lead to irrecoverable errors; whereas, in the one-bit transmittal system described here, only one bit will be affected by such interference and the resulting error can be corrected.

In an embodiment of the present invention, a form of Time Division Multiple Access (TDMA) is used for data transmission. TDMA is widely used in cellular telephone systems to divide a radio frequency channel into a number of time slots, typically three time slots per channel. The system control station allocates these time slots and many bytes are transmitted per slot. In the invention presently described, the transmissions channel is divided into many tens of thousands of free-running time slots with one-bit transmittal per slot. Thus by using TDMA, a control device can communicate with a number of remote monitoring devices simultaneously. This may be required in certain circumstances, for example, when many individual sensors are being used to measure refrigerator temperatures in a supermarket, many athletes are being monitored in a stadium or when many electronic seals are being used to measure the security state of containers in a goods yard.

The embodiments of the present invention disclosed herein can be incorporated into a method and system to monitor the condition or security of cargo during transit and shipment or goods during storage. For example, a receiver fitted to a locomotive pulling a train of numerous shipping containers could continuously monitor their security during transit by receiving the one-bit transmittals from the containers self-sensing electronic seals. The receiver (control device), preferably powered from the locomotive, can then decode and relay this information to a base station by means of a secure cellular telephone or other radio or satellite transmissions system. This system does not require expensive gantries or other infrastructure to be installed to scan the containers as the train passes a checkpoint. In addition, the information can be combined with positional information derived by means of a GPS (Global Positioning by Satellite) system. Analogous systems can be used to monitor the security or condition of containers on the deck or in the cargo hold of a ship, or the temperature of a plurality of packages in a trailer pulled by a truck, or the security and condition of goods in storage.

With the benefit of the teachings presented herein, many modifications and other embodiments of the invention will come to the minds of skilled persons. Therefore, it is to be understood that the invention is not restricted to the details of the foregoing embodiments.

What is claimed is:

1. An apparatus for remotely monitoring variables comprising:

a) one or more independently powered remote monitoring devices having means for sensing variables coupled to a microprocessor for receiving and processing variable data and means for transmitting the variable data to a control device;

b) a control device having a means for receiving variable data from the one or more remote monitoring devices, coupled to a microprocessor for processing variable data and means for transmitting data to the one or more remote monitoring devices;

the one or more remote monitoring devices being momentarily activated for a period of time at programmed intervals, wherein during such momentary activation period the one or more remote monitoring devices transmit a beacon signal to the control device and/or further transmits up to 1 byte of any processed variable data from the and/or a previous momentary activation period, the one or more remote monitoring devices resuming a sleep mode after such transmission(s) and at the end of the momentary activation period, the momentary activation period being extendible by means of a signal transmission from the control device.

2. An apparatus as claimed in claim 1, wherein the one or more remote monitoring devices transmits 1 bit of any processed variable data during the momentary activation period.

3. An apparatus as claimed in claim 1, wherein the extension of the activation period of the one or more remote monitoring devices is reliant upon an activation signal sent from the control device.

4. An apparatus as claimed in claim 1, wherein one or more control devices are linked to further control systems.

5. An apparatus as claimed in claim 1, wherein each remote monitoring device has a unique electronic serial number or address.

6. An apparatus as claimed in claim 1, wherein the transmission means comprises electromagnetic energy.

7. An apparatus as claimed in claim 6, wherein the transmission means comprises one or more or a combination of the following group: radio waves, infra red radiation, microwave radiation and sound waves.

8. An apparatus as claimed in claim 1, wherein the one or more remote monitoring devices is momentarily active for time periods within the range of 1 to 100 micro seconds.

9. An apparatus as claimed in claim 1, wherein the one or more remote monitoring devices is momentarily activated at intervals of about 1 second.

10. An apparatus as claimed in claim 1, wherein the one or more remote monitoring devices is a sensor that measures a physical variable by means of a transducer.

11. An apparatus as claimed in claim 1, wherein the one or more remote monitoring devices is a self-sensing electronic seal.

12. An apparatus as claimed in claim 1, wherein the one or more remote monitoring devices is used to protect and monitor goods in transit or storage.

13. An apparatus as claimed in claim 1, wherein one or more passwords are required prior to establishing transmission between the one or more remote monitoring devices and the control devices.

14. An apparatus as claimed in claim 1, wherein the transmission of data is by means of one-bit transmittal and is a modulated or variable length radio frequency pulse.

15. An apparatus as claimed in claim 1, wherein the transmission of data is by means of one-bit transmittal and is a modulated or variable length infra-red pulse.

16. An apparatus as claimed in claim 1, wherein the transmission of data is by means of a data packet.

17. An apparatus as claimed in claim 16, wherein the data packet contains a checksum.

18. An apparatus as claimed in claim 16, wherein the data packet contains error-correcting codes.

19. An apparatus as claimed in claim 16, wherein the data packet is self-synchronizing.

20. An apparatus as claimed in claim 16, wherein the data packet contains encrypted information.

21. An apparatus as claimed in claim 20, wherein the encrypted information is encrypted by means of rolling-encryption.

22. An apparatus as claimed in claim 1, wherein the control device employs an adaptive reception for one-bit transmittals from the one or more remote monitoring devices.

* * * * *